US009307822B2

(12) United States Patent
Adams et al.

(10) Patent No.: US 9,307,822 B2
(45) Date of Patent: Apr. 12, 2016

(54) COSMETIC CONTAINER

(71) Applicant: TOLY MANAGEMENT LIMITED, Zejtun (MT)

(72) Inventors: Paul Adams, Tarxien (MT); Mario Delia, Zabbar (MT); Philippe Parker, St. Julians (MT); Brian McNamara, Mosta (MT)

(73) Assignee: Toly Management Limited (MT)

( * ) Notice: Subject to any disclaimer, the term of this patent is extended or adjusted under 35 U.S.C. 154(b) by 256 days.

(21) Appl. No.: 14/021,042

(22) Filed: Sep. 9, 2013

(65) Prior Publication Data

US 2014/0086661 A1 Mar. 27, 2014

(30) Foreign Application Priority Data

Sep. 27, 2012 (GB) ..... 1217298.7

(51) Int. Cl.

*A45D 40/04* (2006.01)
*A45D 40/06* (2006.01)
*A45D 40/22* (2006.01)

(52) U.S. Cl.

CPC ..... *A45D 40/04* (2013.01); *A45D 40/065* (2013.01); *A45D 40/22* (2013.01); *A45D 2040/225* (2013.01)

(58) Field of Classification Search

CPC ..... A45D 40/00; A45D 40/02; A45D 40/22; A45D 2040/0025; A45D 2040/0031; A45D 2040/0037

USPC ..... 401/55, 59, 82, 99, 107, 108

See application file for complete search history.

(56) References Cited

U.S. PATENT DOCUMENTS

2005/0081877 A1* 4/2005 Byun ..... A45D 40/023 132/294

* cited by examiner

*Primary Examiner* — Jennifer C Chiang
*Assistant Examiner* — Bradley Oliver
(74) *Attorney, Agent, or Firm* — Barnes & Thornburg LLP

(57) ABSTRACT

A cosmetic container for housing a cosmetic product applicator is presented. The cosmetic container comprises: a cosmetic product applicator; a tubular housing comprising first and second portions; and a platform positioned within the tubular housing and connected to the first portion of the housing, the platform being adapted to receive the cosmetic product applicator inserted into the tubular housing. The first portion of the housing is rotatable relative to the second portion of the housing about an axis of rotation so as to move the platform between a first position, in which substantially the entire length of the cosmetic product applicator is situated within the tubular housing so as to prevent its removal from the housing, and a second position, in which a portion of the cosmetic applicator projects outwardly from the tubular housing so as to permit its removal from the housing.

5 Claims, 7 Drawing Sheets

COSMETIC CONTAINER

FIELD OF INVENTION

The present invention relates to the field of cosmetic containers, and more particularly to cosmetic containers having a tubular housing within which a cosmetic product applicator is inserted.

BACKGROUND TO THE INVENTION

Conventional cosmetic containers comprise: a cosmetic product applicator including a base carrying a stick of cosmetic product (such as lipstick, lip-gloss, foundation, eye shadow, concealer or blusher for example); and a tubular housing (of circular or other section) forming a cap which cooperates with the base to enclose and protect the stick of cosmetic product when the user does not wish to use it.

Various structures have been proposed for lipstick cosmetic containers of the above kind which cater for different types of cosmetic product applicators and/or bases.

It is known to provide a lipstick container in which the base of the lipstick applicator remains outside the tubular housing so as to remain accessible to the user. This provides the risk of unintended separation of the base and the housing. To reduce this risk, and to promote effective closure of the housing onto the base, it is widely known to lock the housing either by screwing or clipping it on. Opening the container (i.e. removing the base from the housing) then requires the user to execute a combination of movements.

The aforementioned conventional cosmetic containers are widely used and have resulted in aesthetics and features which may be viewed as commonplace and boring.

SUMMARY OF THE INVENTION

According to a first aspect of the invention, there is provided a cosmetic container for housing a cosmetic product applicator comprising: a cosmetic product applicator; a tubular housing comprising first and second portions; and a platform positioned within the tubular housing and connected to the first portion of the housing, the platform being adapted to receive the cosmetic product applicator inserted into the tubular housing, wherein the first portion of the housing is rotatable relative to the second portion of the housing about an axis of rotation so as to move the platform between a first position, in which substantially the entire length of the cosmetic product applicator is situated within the tubular housing so as to prevent its removal from the housing, and a second position, in which a portion of the cosmetic applicator projects outwardly from the tubular housing so as to permit its removal from the housing.

Embodiments thus provide a simple and reliable container for a solid, paste or powder cosmetic product, the container including a cosmetic product applicator and a tubular housing into which the cosmetic product applicator is inserted. Such embodiments reduce the risk of unintentional opening, provide original and refined aesthetics, and do not result in an unacceptable overall size.

Also, embodiments provide a container which may offer greater satisfaction and pleasure to a consumer, thereby enhancing the appeal and marketability of the cosmetic product is contains.

With the cosmetic applicator being removable from the tubular housing, embodiments may cater for replacement of the cosmetic applicator, thus enabling a user a lower cost option than replacing the entire container for example. Such embodiments may therefore make it economically viable for a manufacturer to create a more prestigious, substantial and/or and elegant tubular housing which can be re-used with different cosmetic applicators.

The axis of rotation may be parallel or perpendicular to the longitudinal axis of the tubular housing.

Embodiments may therefore provide a cosmetic container which includes a move-to-expose, move-to-hide mechanism for enabling a user to insert or remove a cosmetic product applicator into/from the container. The movement may be a sliding movement of a lever, or may be a push/pull of a lever. Embodiments may thus be described as having a lever mechanism which is movable between two positions to hide or expose the cosmetic product applicator in the container. The cosmetic applicator may thus be offered up to the user in a way that increases its subliminal appeal and thereby its perceived value and attractiveness.

The first portion may comprise a guide track extending around a portion of its periphery and along a portion of its longitudinal length, and the platform may comprise a projection adapted to engage with the guide track so as to permit movement of the projection along the guide track which thereby results in movement of the platform along the longitudinal axis of the tubular housing.

An end of the first portion may be connected to the platform, and the first portion may be pivotally connected to the second portion at a pivot point positioned between opposite ends of the first portion so as to permit rotation of the first portion about the axis of rotation which thereby results in movement of the platform along the longitudinal axis of the tubular housing.

The end of the first portion may be slidably connected to the platform to permit movement of the first portion relative to the platform in a direction perpendicular to the longitudinal axis of the tubular housing.

The cosmetic product applicator may be provided in stick form and the cosmetic product may be any facial or bodily cosmetic or beauty treatment product including lipstick, lip-gloss, eye-brow, eye-shadow, concealer, blusher, foundation, skin-treatment and the like.

BRIEF DESCRIPTION OF THE DRAWINGS

An example of the invention will now be described with reference to the accompanying diagrams, in which.

DETAILED DESCRIPTION

Figure 1:
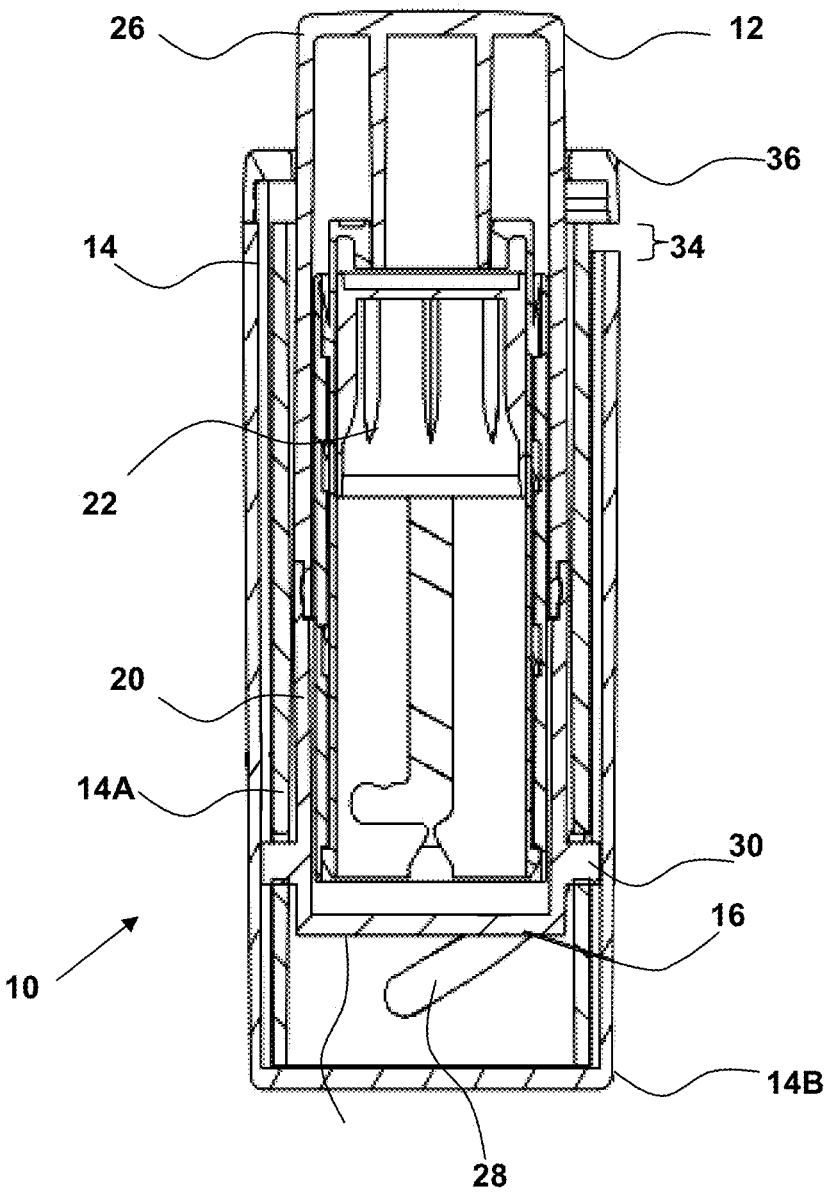
FIG. 1 is a cross sectional view of a lipstick container according to an embodiment of the invention.
Figure 2:
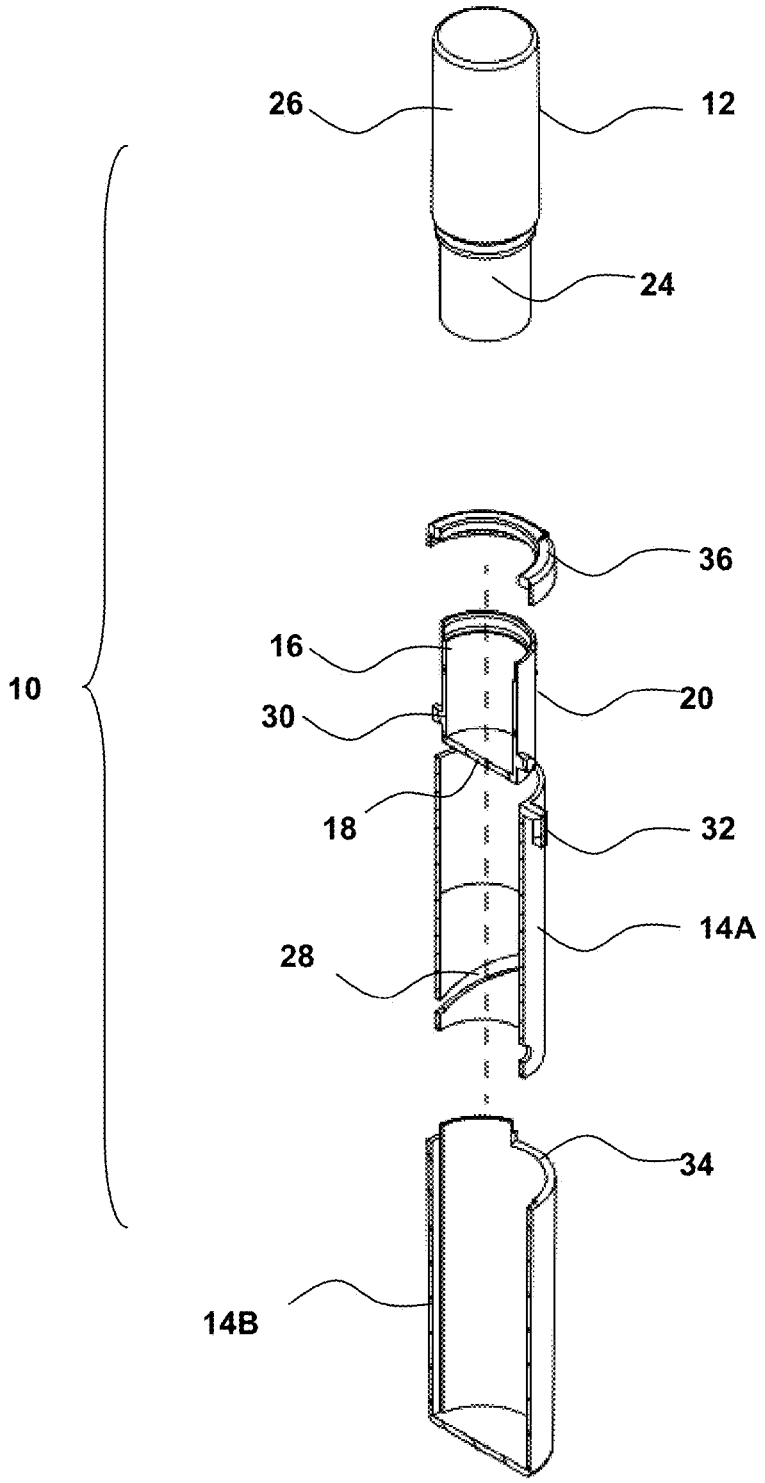
FIG. 2 is an exploded diagram of the lipstick container of FIG. 1.

Referring to FIGS. 1 and 2, there is shown a lipstick container 10 according to an embodiment of the invention. The lipstick container comprises a lipstick applicator 12, a tubular housing 14 (of circular section) and a platform 16 slidably mounted within the tubular housing.

The platform 16 is formed in the shape of a cup having a flat bottom portion 18 and a side portion 20 formed around the periphery of the bottom portion 18 and extending perpendicularly from the flat bottom portion 18. The platform 16 is thus adapted to receive the lipstick applicator 12 when it is inserted into the tubular housing 14. More specifically, the lip of the side portion 20 is adapted to engage with the lipstick applicator 12 such that the lipstick applicator 12 can be connected/released to/from the platform 16 with a click-type movement.

Here, the lipstick applicator 12 comprises a support 22 carrying a stick of lipstick 24, and a tubular body 26 (of circular section) in which the support may be moved axially (along the longitudinal axis of the lipstick applicator 12) to deploy the lipstick 24 or retract it into the tubular body 26.

The tubular housing 14 comprises first 14A and second 14B portions. The first portion 14A is a tubular sleeve (of circular section) adapted to receive the platform 16 such that the platform 16 can move, with respect the tubular sleeve, along the longitudinal axis of the lipstick applicator 12 and also rotate about the longitudinal axis of the lipstick applicator 12.

The tubular sleeve 14A comprises a guide track 28 formed from a helical slot extending around a portion of the periphery of the tubular sleeve 14A. In other words, the guide track 28 comprises a channel 28 that is formed in the inside surface of the tubular sleeve 14A such that it extends both horizontally and vertically around the inside of the tubular sleeve 14A to form a spiral-like pathway that is tilted from both the horizontal and vertical/longitudinal axis of the tubular sleeve 14A.

The platform comprises a projection or peg 30 extending radially from the outside of its side portion 20 such that it is adapted to engage with the guide track 28 (when the platform 16 is inserted inside the tubular sleeve 14A) and to permit movement of the peg 30 along the guide track 28. Thus, rotational movement of the tubular sleeve 14A about the longitudinal axis of the tubular sleeve 14A relative to the platform 16 results in the peg 30 moving along the guide track 28 and thereby causes axial movement of the platform 16 along the longitudinal axis of the tubular sleeve 14A. Put another way, a twisting movement of the tubular sleeve 14A causes the platform 16 to move along the longitudinal axis of the tubular sleeve 14A as guided by the guide track 28.

Here, clock-wise rotation of the tubular sleeve 14A (when viewed from above the top end (i.e. the end of the container 10 into which the lipstick applicator is inserted) of the container 10 in FIG. 1) causes the peg 30 to be pushed in a downward-left direction along the guide track 28 shown in FIG. 1, thus resulting in downward movement of the platform 16. Conversely, anticlock-wise rotation of the tubular sleeve causes the peg 30 to be pushed in a upward-right direction along the guide track 28 shown in FIG. 1, thus resulting in upward movement of the platform 16.

The second portion 14B of the housing 14 is a tubular outer-casing 14B being open at one end and closed at the other end. The first portion 14A (i.e. the tubular sleeve) of the housing 14 is inserted within the tubular outer-casing 14B and arranged such it is rotatable relative to the second portion 14B of the housing about the longitudinal axis of the housing 14. To effect such rotation, the tubular sleeve 14A is provided with a handle 32 that projects radially from its outside surface, and the second portion 14B of the housing 14 is provided with a horizontally elongate notch, channel or hole 34 in its outer surface through which the handle 32 of the tubular sleeve 14A projects outwardly from the container 14. Thus, with the tubular sleeve 14A inserted into tubular outer-casing 14B, the handle 32 of the tubular sleeve 14A extends outside of the outer casing 14B and enables a user to effect rotational movement of the tubular sleeve 14A (even though it is situated within tubular outer-casing 14B).

To prevent removal of the tubular sleeve 14A and platform 16 from within the tubular outer-casing 14B, a collar 36 is attached to the top rim (i.e. the open end) of the tubular outer-casing 14B. It will therefore be appreciated that the second portion 14B of the housing 14 forms an outer sleeve or outer casing that houses the first portion 14A and the platform 16 such that they are movable relative to the second portion but cannot be removed.

The abovementioned arrangement means that the platform 16 is slidably mounted within the tubular housing 14 and connected to the first portion 14A of the housing. The first portion 14A of the housing is movable, relative to the second portion of the housing, about the longitudinal axis of the housing so as to move the platform 16 axial (along the longitudinal axis of the housing). In this way, the platform is movable up and down the longitudinal shaft of the housing 14 between a first and second position.

Figure 3A:
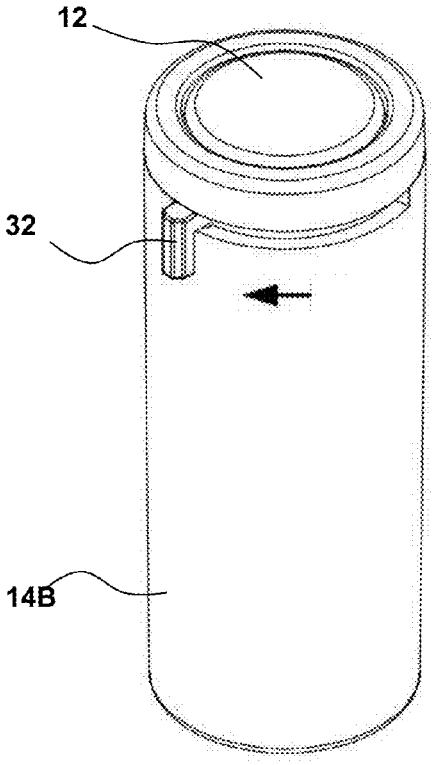
FIG. 3A illustrates the configuration of the embodiment of FIGS. 1 and 2 when the platform is in a first position.
Figure 3B:
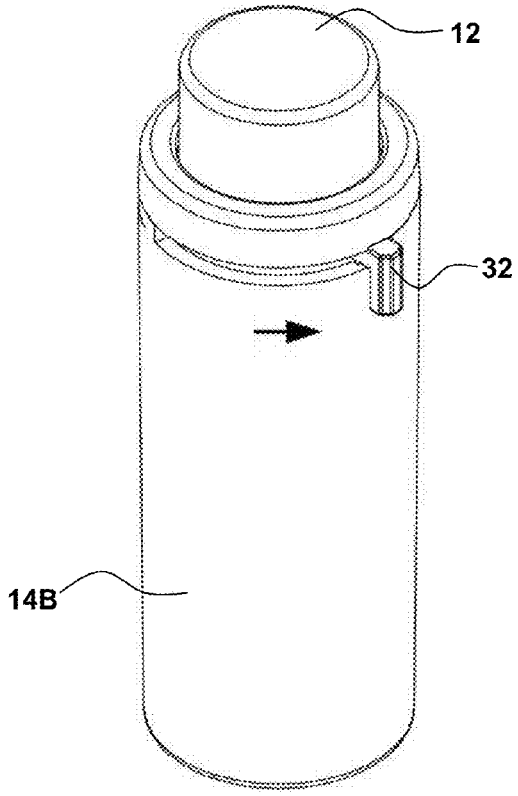
FIG. 3B illustrates the configuration of the embodiment of FIGS. 1 and 2 when the platform is in a second position

Referring now to FIGS. 3A and 3B, the difference in the configuration of the container between the first and second positions is shown.

FIG. 3A shows the configuration of the container when the platform 16 is in a first position. Here, the handle 32 of the tubular sleeve 14A has been moved in an clockwise direction (when viewed from above the top end of the container 10) such that it is positioned at the left-hand end of the elongate hole 34 and the peg 30 has been pushed in a downward-left direction along the guide track 28. This results in substantially the entire length of the lipstick applicator 12 being situated within the tubular housing 14 such that the flat base of the tubular body 26 of the lipstick applicator 12 is substantially flush with the flat surface of the collar 36. Thus, when the platform 16 is in the first position, the lipstick applicator 12 is retracted into the tubular housing 14 so as to prevent its removal.

FIG. 3B shows the configuration of the container when the platform 16 is in a second position. Here, the handle 32 of the tubular sleeve 14A has been moved in an anti-clockwise direction (when viewed from above the top end of the container 10) such that it is positioned at the right-hand end of the elongate hole 34 and the peg 30 has been pushed in an upward-right direction along the guide track 28. This results in a portion of the lipstick applicator 12 projecting outwardly from the tubular housing (along the longitudinal axis of the housing). Thus, when the platform 16 is in the second position, the lipstick applicator 12 is deployed for removal by a user. The user can grip the portion of the lipstick applicator 12 that is exposed (i.e. the portion projecting beyond the collar 36) and pull it to release it from the platform 16.

The lipstick container described above (with reference to FIGS. 1-3) therefore includes opening and closing mechanism which can be described has a slide-to-expose, slide-to-hide mechanism for enabling a user to secure or deploy a lipstick applicator within/from the container. The sliding movement is that of a lever or handle which effects rotation of the tubular sleeve 14A in relation to the tubular outer-casing 14B about a longitudinal axis of the container.

Figure 4:
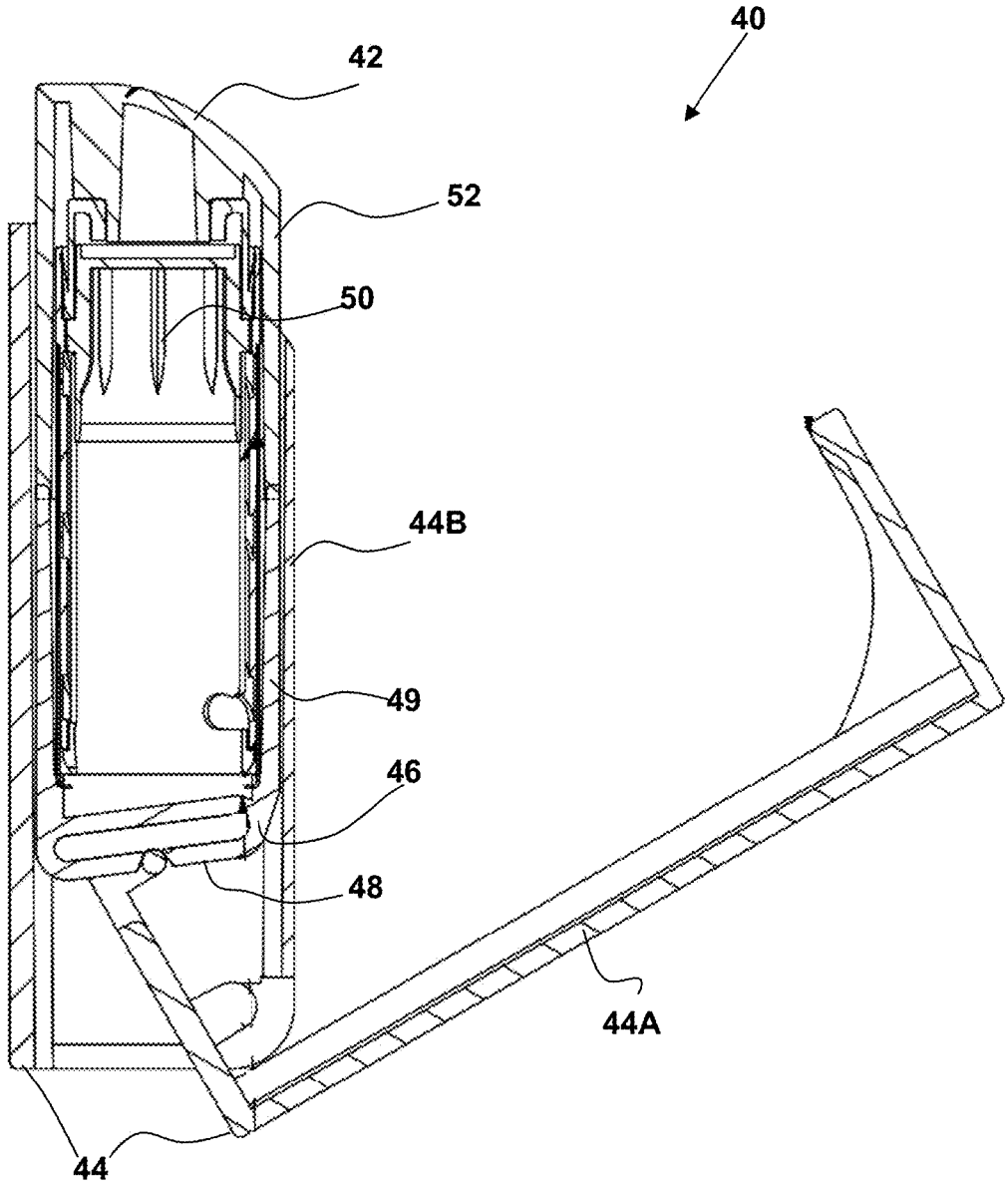
FIG. 4 is a cross sectional view of a lipstick container according to another embodiment of the invention.
Figure 5:
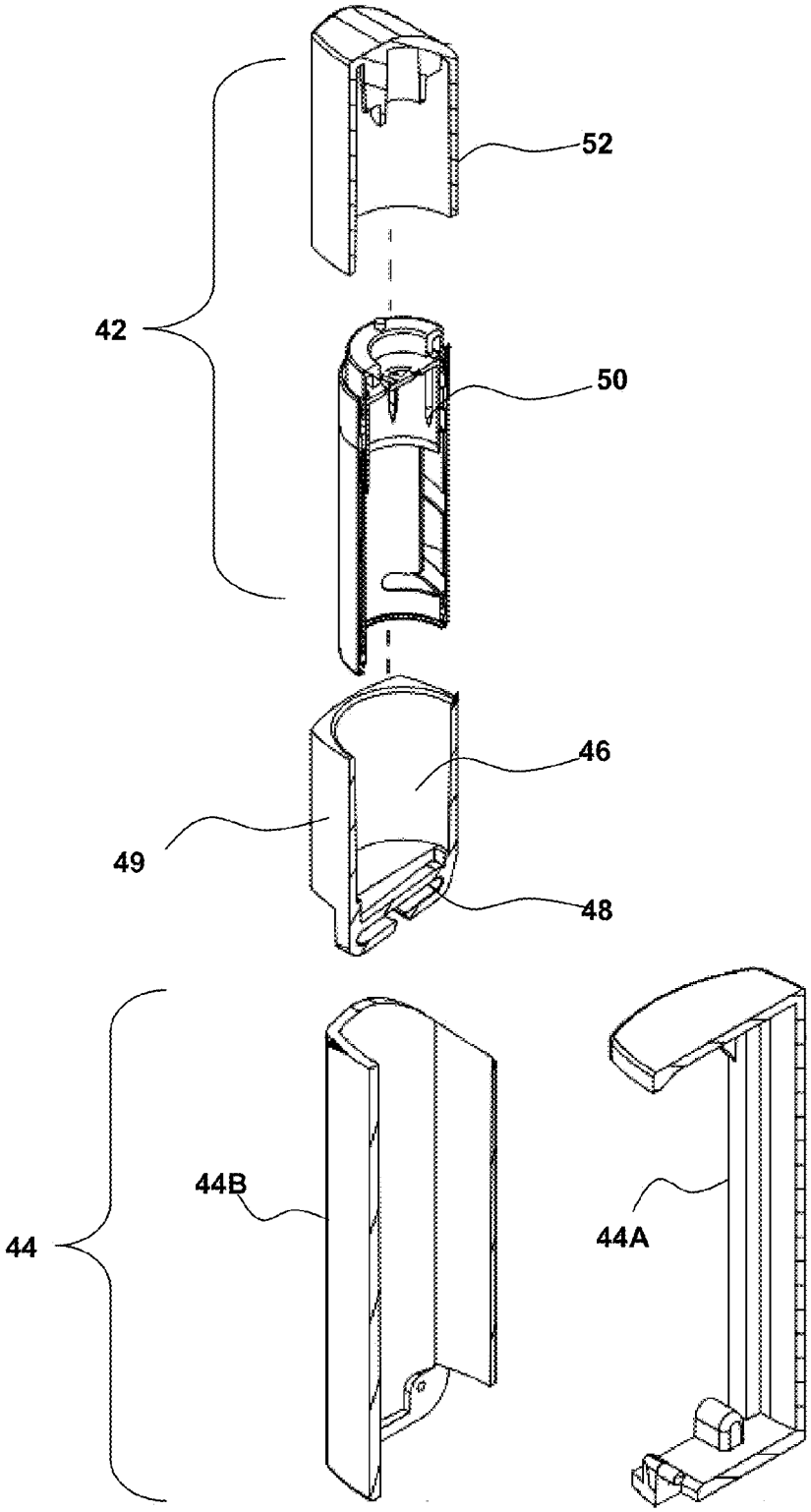
FIG. 5 is an exploded cross-sectional diagram of the lipstick container of FIG. 4.

Referring to FIGS. 4 and 5, there is shown a lipstick container 40 according to another embodiment of the invention. The lipstick container comprises a lipstick applicator 42, a tubular housing 44 (of substantially rectangular section) and a platform 46 slidably mounted within the tubular housing.

The platform 46 is formed in the shape of a cup having a bottom portion 48 from which a side portion 49 projects upwardly around its periphery. The platform 46 is adapted to receive the lipstick applicator 42 when it is inserted into the tubular housing 44. More specifically, the lip of the side portion 49 is adapted to engage with the lipstick applicator 42 such that the lipstick applicator 42 can be connected/released to/from the platform 46 with a click-type movement.

The lipstick applicator 42 comprises a support 50 for carrying a stick of lipstick (not shown), and a tubular body 52 (of substantially rectangular section) in which the support 50 may be moved axially (along the longitudinal axis of the lipstick applicator 42) to deploy or retract the lipstick.

The tubular housing 44 comprises first 44A and second 44B portions. The first portion 44A is an elongate member that is adapted to form a first and bottom side of the tubular housing 44. The first portion 44A is also adapted to pivotally connected to the platform 46 towards the end which forms the bottom side of the tubular housing 44, thereby permitting movement of the platform 16, with respect the tubular housing 44, along the longitudinal axis of the tubular housing 44.

The second portion 44B is an elongate member having a U-shaped cross-section that is adapted to form the remaining three sides of the tubular housing 44. Thus, the housing 44 comprises three vertical sides, a bottom side, and an open end opposite the bottom side.

The first portion 44A is also pivotally connected to the second portion 44B such that it can rotate, with respect to the second portion 44B, about an axis of rotation that is perpendicular to the longitudinal axis of the housing 44. The axis of rotation is spaced apart from the pivotal connection made between the first portion 44A and the platform 46.

Rotational movement of the first portion 44A about the axis of rotation (that is perpendicular to the longitudinal axis of the housing 44) causes axial movement of the platform 46 along the longitudinal axis of the tubular sleeve tubular housing 44. Put another way, push or pull movement of the first portion 44A (acting a lever-type component) causes the platform 16 to move down or up the longitudinal shaft of the tubular housing 44.

Here, clock-wise rotation of the first portion 44A (as viewed from the angle and orientation shown in FIG. 1) causes the pivotal connection between the end of the first portion 44A and the platform 46 to be pushed in an upward direction, thus resulting in upward movement of the platform 46. Conversely, anticlock-wise rotation of the first portion 44A causes the pivotal connection between the end of the first portion 44A and the platform 46 to be pulled in a downward direction, thus resulting in downward movement of the platform 46.

The abovementioned arrangement means that the platform 16 is slidably mounted within the tubular housing 44 and connected to the first portion 44A of the housing. The first portion 44A of the housing is movable, relative to the second portion of the housing, about an axis of rotation (that is perpendicular to the longitudinal axis of the housing 444) so as to move the platform 46 axially (along the longitudinal axis of the housing). In this way, the platform is movable up and down the longitudinal shaft of the housing 44 between a first and second position.

Figure 6A:
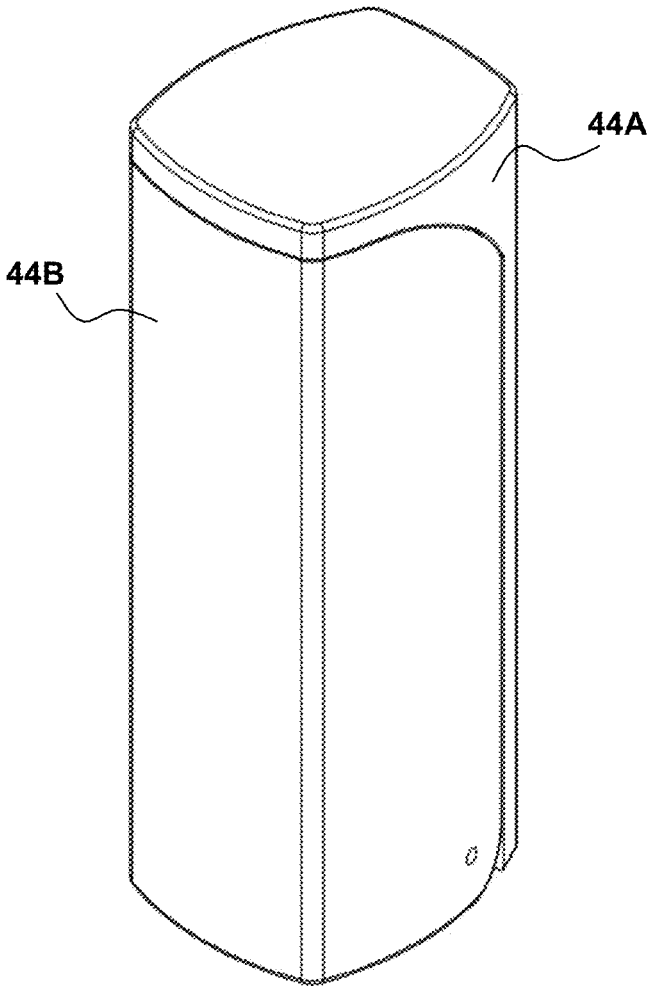
FIG. 6A illustrates the configuration of the embodiment of FIGS. 4 and 5 when the platform is in a first position.
Figure 6B:
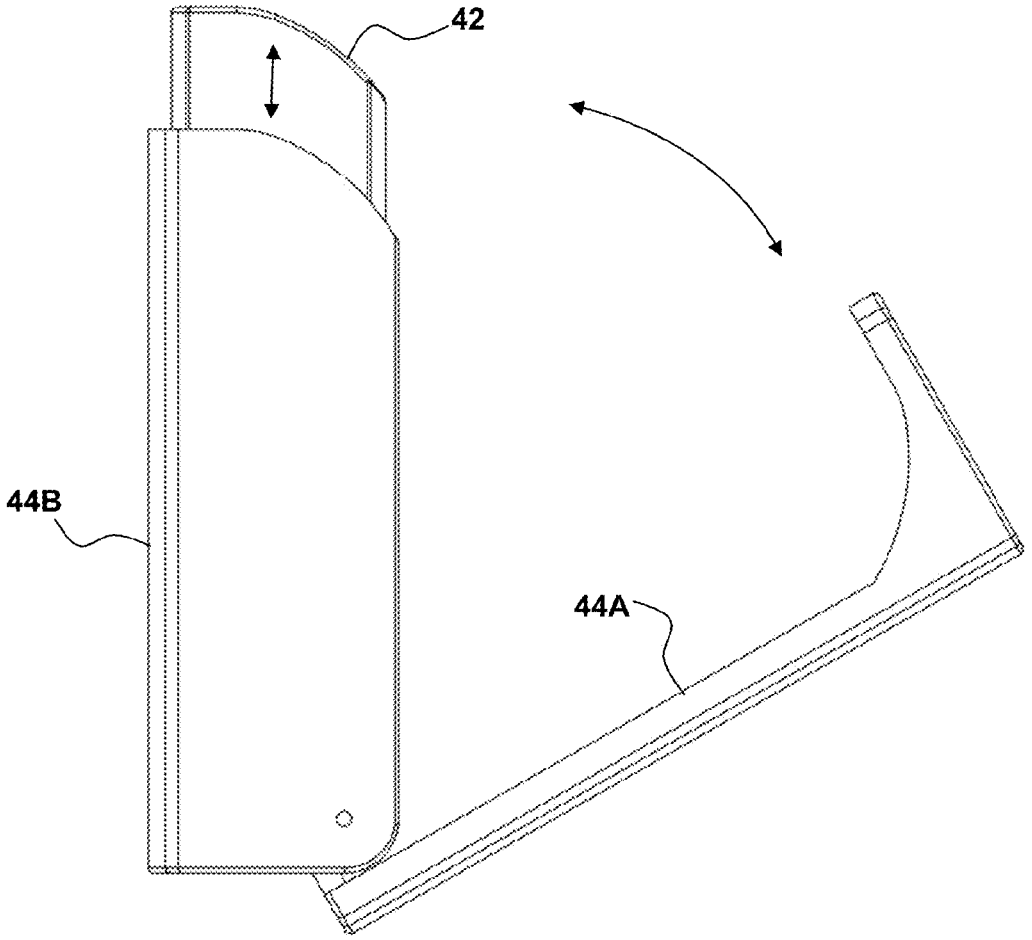
FIG. 6B illustrates the configuration of the embodiment of FIGS. 4 and 5 when the platform is in a second position.

Referring now to FIGS. 6A and 6B, the difference in the configuration of the container 40 between the first and second positions is illustrated.

FIG. 6A shows the configuration of the container when the platform 46 is in a first position. Here, the first portion 44A of the housing 44 has been moved in an anti-clockwise direction (as viewed from angle and orientation shown in FIG. 6A) such that it closes the housing 44 to encase the lipstick applicator 42 and the platform 46 therewithin. In other words, the container 40 is in a closed configuration with the entire length of the lipstick applicator 12 being situated within the tubular housing 44. Thus, when the platform 46 is in the first position, the lipstick applicator 40 is retracted into the tubular housing 44 so as to prevent its removal.

FIG. 6B shows the configuration of the container when the platform 46 is in a second position. Here, the first portion 44A of the housing 44 has been moved in a clockwise direction (as viewed from angle and orientation shown in FIG. 6B) such that the distal end of the first portion 44A is separated from the top end of the second portion 44B and the housing 44 is opened. Also, the clockwise movement of the first portion 44A causes the platform 46 to be pushed in an upward direction, thus resulting in upward movement of the lipstick applicator 40 such that its projects outwardly from the tubular housing (along the longitudinal axis of the housing). Thus, when the platform 46 is in the second position, the lipstick applicator 40 is deployed for removal by a user. The user can grip the portion of the lipstick applicator 40 that is exposed (i.e. the portion projecting beyond the longitudinal extent of the second portion 44B) and pull it to release it from the platform 46.

The lipstick container described above (with reference to FIGS. 4-6) therefore includes opening and closing mechanism which can be described has a pull-to-expose, push-to-hide mechanism for enabling a user to secure or deploy a lipstick applicator within/from the container. The push/pull movement is that of a lever or handle which effects rotation of the tubular sleeve 14A in relation to the tubular outer-casing 14B about a rotation axis which is perpendicular to the longitudinal axis of the container.

While specific embodiments have been described herein for purposes of illustration, various modifications will be apparent to a person skilled in the art and may be made without departing from the scope of the invention.

For example, although the embodiments described above contain lipstick, it will be appreciated that other embodiments may be used to contain a cosmetic product applicator for other types of cosmetic products (such as lip-gloss, foundation, eye shadow, mascara or blusher for example).

Thus, an alternative embodiment may be adapted to contain a mascara product into which a mascara applicator is inserted. The tubular housing may also contain a wiper that is adapted to retain excess product picked up by the applicator.

Also, although the embodiments have been described having tubular housing with a circular or rectangular cross-sectional shape, other embodiments may comprise tubular housing have a different cross-sectional shape (such a regular or irregular polygonal shape).

The invention claimed is:

1. A cosmetic container for housing a cosmetic product applicator comprising:

a cosmetic product applicator;

a tubular housing comprising first and second portions; and a platform positioned within the tubular housing and connected to the first portion of the housing, the platform being adapted to receive the cosmetic product applicator inserted into the tubular housing, wherein the first portion of the housing is rotatable relative to the second portion of the housing about an axis of rotation so as to move the platform between a first position, in which substantially the entire length of the cosmetic product applicator is situated within the tubular housing so as to prevent its removal from the housing, and a second position, in which a portion of the cosmetic applicator projects outwardly from the tubular housing so as to permit its removal from the housing, wherein the axis of rotation is perpendicular to the longitudinal axis of the tubular housing, wherein rotation of the first portion about the axis of rotation in a first direction of rotation causes the first portion to push the platform along the longitudinal axis of the tubular housing towards the second position, and wherein rotation of the first portion about the axis of rotation in a second direction of rotation opposite to the first direction of rotation causes the first portion to pull the platform along the longitudinal axis of the tubular housing towards the first position.

2. A cosmetic container according to claim 1, wherein the platform is connected at one end of the first portion, and wherein the first portion is pivotally connected to the second portion at a pivot point positioned between opposite ends of the first portion so as to permit rotation of the first portion about the axis of rotation which thereby results in movement of the platform along the longitudinal axis of the tubular housing.

3. A cosmetic container according to claim 2, wherein the end of the first portion is movably connected to the platform to permit movement of the first portion relative to the platform.

4. A cosmetic container according to claim 1, wherein the cosmetic product applicator comprises a stick of cosmetic product.

5. A cosmetic container according to claim 1, wherein the cosmetic product is lipstick, lip-gloss, foundation, mascara, blusher or eyeshadow.

* * * * *